US006871505B2

(12) United States Patent
So et al.

(10) Patent No.: US 6,871,505 B2
(45) Date of Patent: Mar. 29, 2005

(54) COMPRESSOR-CONTROLLING DEVICE AND METHOD FOR AIR CONDITIONER COMPRISING A PLURALITY OF COMPRESSORS

(75) Inventors: Min Ho So, Seoul-si (KR); Won Hee Lee, Seoul-si (KR); Chang Min Choi, Seoul (KR); Yoon Jei Hwang, Seoul (KR); Deok Huh, Buchun-si (KR); Cheol Min Kim, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/377,638

(22) Filed: Mar. 4, 2003

(65) Prior Publication Data

US 2004/0003605 A1 Jan. 8, 2004

(30) Foreign Application Priority Data

Jul. 3, 2002 (KR) ..... 2000-38377

(51) Int. Cl.[7] ..... F25B 7/00
(52) U.S. Cl. ..... 62/157; 62/175; 236/1 EA
(58) Field of Search ..... 62/157, 158, 175, 62/231, 510; 236/1 EA; 417/12

(56) References Cited

U.S. PATENT DOCUMENTS 5,572,878 A * 11/1996 Kapoor ..... 236/1 EA
5,634,345 A * 6/1997 Alsenz ..... 62/84
5,901,559 A * 5/1999 Westermeyer et al. ..... 62/84

FOREIGN PATENT DOCUMENTS

JP 405052384 * 3/1993 ..... 62/231

* cited by examiner

*Primary Examiner*—Harry B. Tanner
(74) *Attorney, Agent, or Firm*—Greenblum & Bernstein, P.L.C.

(57) ABSTRACT

Disclosed are compressor-controlling device and method for an air conditioner comprising a plurality of compressors. In case several compressors selected from the plural compressors are stopped for a long period of time according to cooling or heating load, the refrigerant contained in a higher-pressure state inside of the stopped compressors moves toward a refrigerant pipe of a lower-pressure inlet port, and oil used to operate the compressors leaks toward the inlet port, thus lowering the oil level within the stopped compressors. Since the stopped compressors are operated during a second designated time when stopped time of the stopped compressors exceeds a first designated time, the stopped compressors are protected from damage due to poor lubrication.

10 Claims, 5 Drawing Sheets

COMPRESSOR-CONTROLLING DEVICE AND METHOD FOR AIR CONDITIONER COMPRISING A PLURALITY OF COMPRESSORS

BACKGROUND OF THE INVENTION

1. Field of the Invention

The present invention relates to compressor-controlling device and method for an air conditioner comprising a plurality of compressors, and more particularly to compressor-controlling device and method for an air conditioner comprising a plurality of compressors, so that the lowering of an oil level within non-operating compressors is prevented, thereby protecting the compressors from damage due to poor lubrication.

2. Description of the Related Art

Generally, an air conditioner comprises a compressor for compressing a gaseous refrigerant in a low-temperature and low-pressure state so as to convert it into a high-temperature and high-pressure state, a condenser for condensing the gaseous refrigerant in the high-temperature and high-pressure state compressed by the compressor so as to convert it into a liquid refrigerant in a mid-temperature and high-pressure state, an expansion device for decompressing the liquid refrigerant in the mid-temperature and high-pressure state condensed by the outdoor heat exchanger so as to convert it into a low-temperature and low-pressure state, and an evaporator for evaporating the liquid refrigerant in the low-temperature and low-pressure state decompressed by the expansion device so as to convert it into a gaseous refrigerant in a low-temperature and low-pressure state.

In case of a heat-pump air conditioner, an indoor heat exchanger and an outdoor heat exchanger respectively serve as different means according to cooling and heating modes. In the heating mode, the indoor heat exchanger serves as a condenser and the outdoor heat exchanger serves as an evaporator. On the other hand, in the cooling mode, the indoor heat exchanger serves as an evaporator and the outdoor heat exchanger serves as a condenser.

Further, recently, air conditioners have employed a plurality of compressors having different capacities so as to variably change the total capacity of the compressors according to the variation of the cooling or heating load.

In the conventional air conditioner comprising plural compressors, in case several compressors selected from the plural compressors are operating according to the cooling or heating load and the other compressors have stopped for a long period of time, the refrigerant contained in a high-pressure state inside of the stopped compressors moves toward a refrigerant pipe of a lower-pressure inlet port, and oil used to operate the compressors leaks toward the inlet port. Thereby, an oil level within the stopped compressors is lowered, and when the stopped compressors are operated, the compressors are damaged due to poor lubrication.

SUMMARY OF THE INVENTION

Therefore, the present invention has been made in view of the above problems, and it is an object of the present invention to provide compressor-controlling device and method for an air conditioner comprising a plurality of compressors, in which stopped compressors are intermittently operated when the compressors are selectively operated for satisfying the variation of cooling or heating load, thereby protecting the compressors from damage due to poor lubrication.

In accordance with one aspect of the present invention, the above and other objects can be accomplished by the provision of a compressor-controlling device for an air conditioner comprising a plurality of compressors, in which the plural compressors are simultaneously or selectively operated according to cooling or heating load, comprising: a timer for sensing stopped time of stopped compressors selected from the plural compressors according to the cooling or heating load; a comparing unit for determining whether the stopped time sensed by the timer exceeds a first designated time; and a control unit for operating the stopped compressors in case the comparing unit judges that the stopped time exceeds the first designated time.

In accordance with another aspect of the present invention, there is provided a compressor-controlling method for an air conditioner comprising a plurality of compressors, in which the plural compressors are simultaneously or selectively operated according to cooling or heating load, comprising: the first step of sensing stopped time of stopped compressors when several compressors selected from the plural compressors are stopped according to the cooling or heating load; the second step of determining whether the stopped time exceeds a first designated time; and the third step of operating the stopped compressors when it is judged that the stopped time exceeds the first designated time of the second step.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
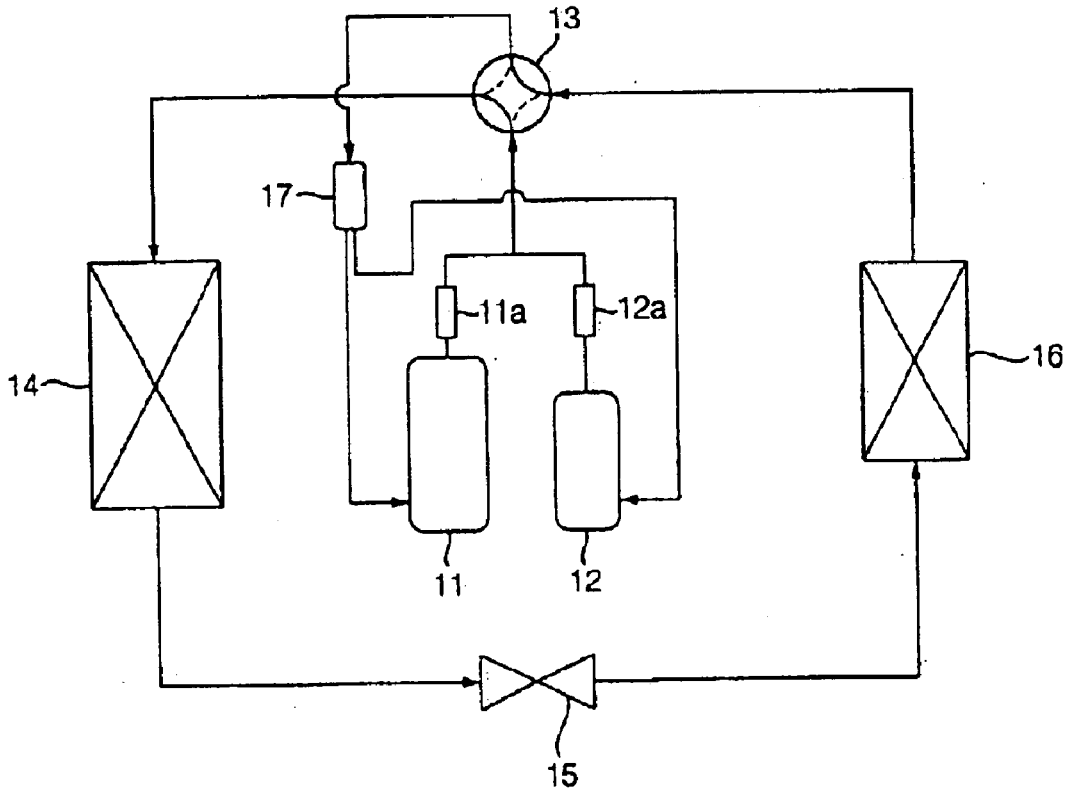
FIG. 1 (Prior Art)
FIG. 1 is a block diagram of a conventional air conditioner comprising a plurality of compressors.

As shown in FIG. 1, a general heat-pump air conditioner with a plurality of compressors comprises first and second compressors 11 and 12 having different capacities, check valves 11*a* and 12*a*, a four-way valve 13, an outdoor heat exchanger 14, an expansion valve 15, an indoor heat exchanger 16, and an accumulator 17. The first and second compressors 11 and 12 compress a gaseous refrigerant so as to convert it into a high-temperature and high-pressure state. The check valves 11*a* and 12*a* respectively prevent the reverse-flow of the refrigerant compressed by the first and second compressors 11 and 12. The four-way valve 13 converts the flow direction of the refrigerant discharged from the first and second compressors 11 and 12, thereby reversing functions of the outdoor and indoor heat exchangers 14 and 16. In the cooling mode, the outdoor heat exchanger 14 exchanges heat between external air and the refrigerant, thereby condensing the gaseous refrigerant in the high-temperature and high-pressure state, so as to convert it into a liquid refrigerant in a mid-temperature and high-pressure state. The expansion valve 15 decompresses the liquid refrigerant discharged from the outdoor heat exchanger 14, so as to convert it into a low-temperature and low-pressure state. The indoor heat exchanger 16 exchanges heat between the indoor air and the refrigerant discharged from the expansion valve 15 so as to convert it into a two-phase refrigerant in liquid and gaseous phases. The accumulator 17 separates the liquid phase from the two-phase refrigerant discharged from the indoor heat exchanger 16, and then supplies only the gaseous phase to the first and second compressors 11 and 12.

Herein, according to the variation of the cooling or heating load, the first and second compressors 11 and 12 are simultaneously or selectively operated.

A compressor-controlling device for an air conditioner in accordance with a preferred embodiment of the present invention is described with reference to FIG. 2, as follows.

Figure 2:
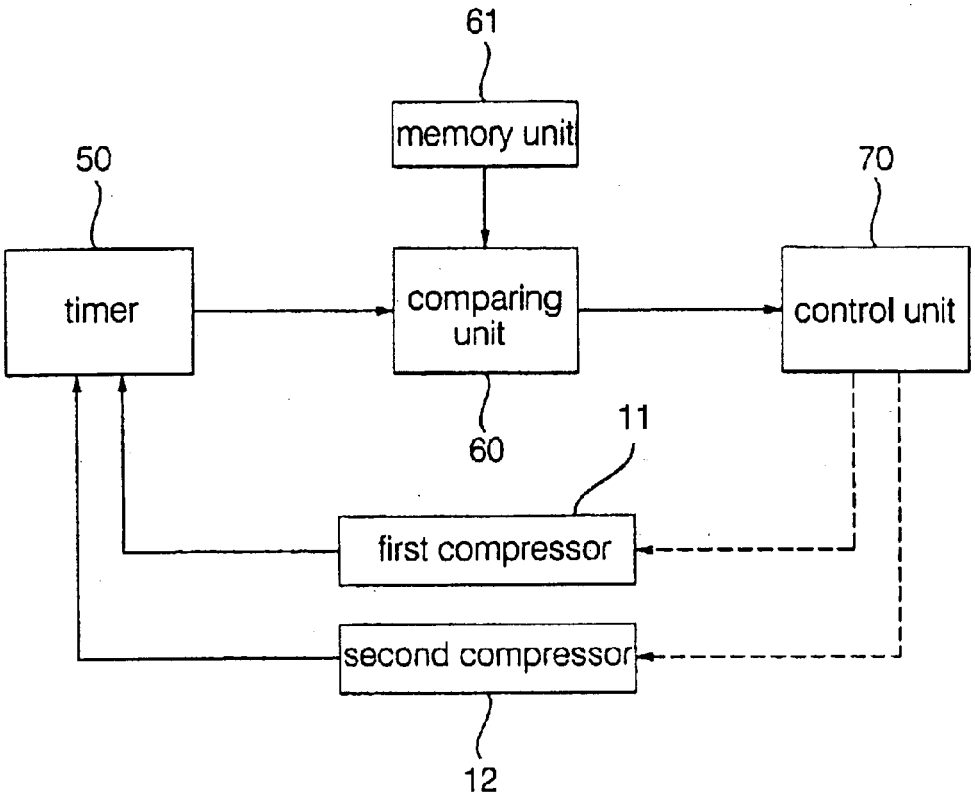
FIG. 2 is a block diagram of a compressor-controlling device for an air conditioner comprising a plurality of compressors in accordance with the present invention.

First and second compressors of FIG. 2 denote the first and second compressors 11 and 12 shown in FIG. 1. The compressor-controlling device for an air conditioner of the present invention comprises a timer 50, a comparing unit 60, and a control unit 70. When one compressor selected from the compressors 11 and 12 is operated and the other compressor is stopped according to the cooling or heating load, the timer 50 senses stopped time (t) of the stopped compressor. The comparing unit 60 determines whether the stopped time sensed by the timer 50 exceeds a designated first time. The control unit 70 operates the stopped compressor when the comparing unit 60 judges that the stopped time exceeds the first designated time.

Herein, the first designated time denotes time required to cause a lowering of the oil level within the stopped compressor, when the stopped compressor maintains its stopped state for a long period of time and then oil contained within the stopped compressor leaks toward a refrigerant pipe of an inlet port. The first designated time is experimentally determined.

The comparing unit 60 determines whether the stopped compressor maintains its stopped state for the first designated time. When the comparing unit 60 judges that the stopped time of the stopped compressor exceeds the first designated time, the controlling unit 70 operates the stopped compressor.

Then, after a lapse of a second designated time from the operation of the stopped compressor, the compressor is re-stopped. The second designated time denotes time required to restore the oil level, i.e., to raise the oil level. The second designated time is also experimentally determined.

The first and second designated times are stored in a memory unit 61 of the comparing unit 60. Therefore, the comparing unit 60 compares the stopped time of the first or second compressor 11 or 12 sensed by the timer 50 to the stored first and second designated times.

Figure 3:
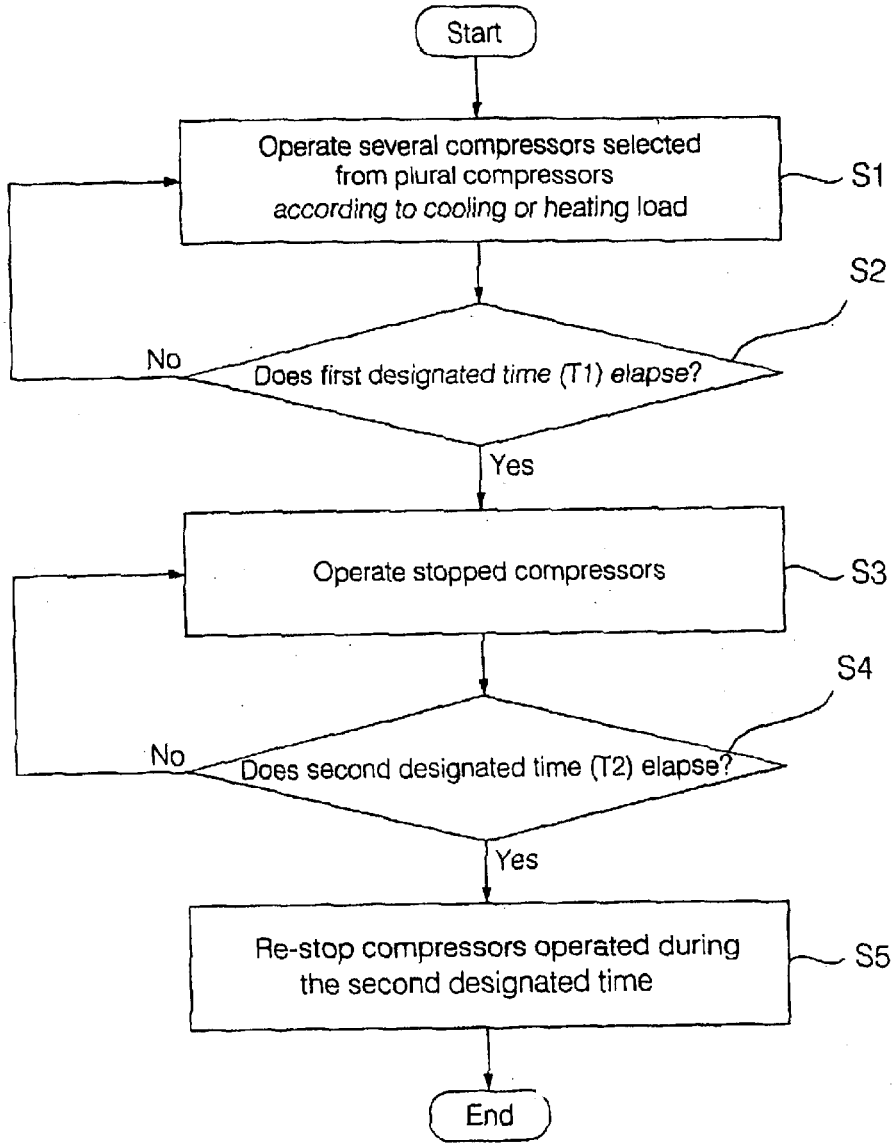
FIG. 3 is a flow chart illustrating a compressor-controlling method for an air conditioner comprising a plurality of compressors in accordance with the present invention.

A compressor-controlling method for an air conditioner in accordance with the preferred embodiment of the present invention is described with reference to FIG. 3, as follows.

In first step, several compressors selected from the plural compressors are operated, and the other compressors are stopped according to cooling or heating load. (S1)

In second step, when the stopped compressors maintain their stopped states for longer than the first designated time (T1), the stopped compressors of first step are operated. (S2 and S3)

That is, in case the first compressor 11 is operated and the second compressor 12 is stopped according to the cooling or heating load in first step, when the second compressor 12 maintains its stopped state for longer than the first designated time (T1), the second compressor 12 is operated.

In third step, after a lapse of the second designated time (T2), the operating compressor in the second step, i.e., the second compressor 12, is re-stopped. (S4 and S5)

As a result, in case of the air conditioner with a plurality of compressors, several compressors of the plural compressors are selectively operated according to cooling or heating load, and when the cooling or heating load is not changed, the other compressors maintain their stopped states for a long period of time.

Herein, the refrigerant contained by a higher-pressure inside of the stopped compressor moves toward a refrigerant pipe of a lower-pressure inlet port, and oil used to operate the compressor leaks toward the inlet port. Thereby, the oil level within the stopped compressor is lowered.

Therefore, the stopped compressor, which maintains its stopped state for longer than the first designated time (T1), is operated for the second designated time (T2) so that the lowered oil level is restored.

The variations of oil levels in the operating compressor and the non-operating compressor according to the cooling or heating load are described with reference to FIGS. 4 and 5, as follows.

Figure 4:
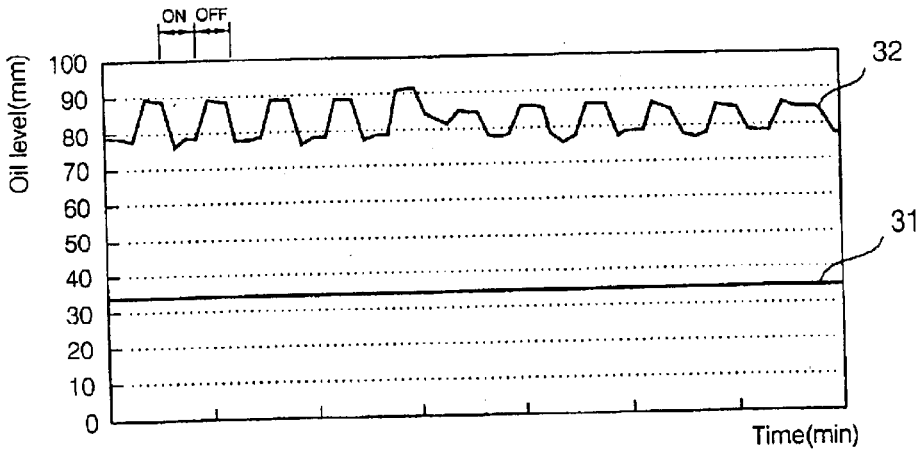
FIG. 4 is a graph illustrating an oil level within an operating compressor in the controlling method for an air conditioner comprising a plurality of compressors in accordance with the present invention.
Figure 5:
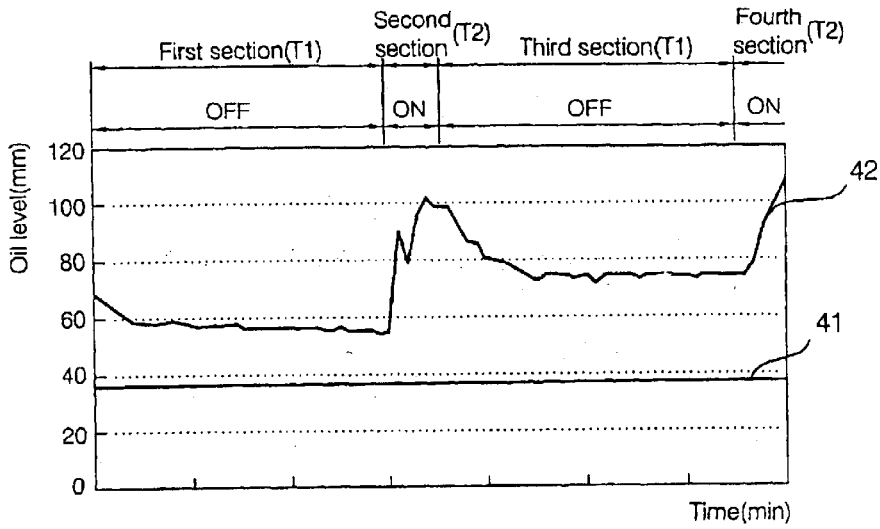
FIG. 5 is a graph illustrating an oil level within an intermittently stopping and operating compressor in the controlling method for an air conditioner comprising a plurality of compressors in accordance with the present invention.

As shown in FIG. 4, since the operating compressor according to the cooling or heating load is repeatedly turned on and off via a cooling or heating cycle, the operating compressor uniformly maintains an oil level 32 therein.

On the other hand, as shown ir. FIG. 5, since the non-operating compressor in first step maintains its stopped state during the first designated time (T1), compared to the uniformly maintained oil level 32 of FIG. 4, oil level 42 within the non-operating compressor is gradually lowered in first section. The non-operating compressor is damaged due to is poor lubrication due to the lowered oil level. In order to solve such a problem, when the stopped time of the non-operating compressor exceeds the first designated time (T1), the non-operating compressor is operated during the second designated time (T2) in second section, thereby restoring the lowered oil level within the non-operating compressor. Then, the operation of the compressor is re-stopped.

Repeatedly, the stopped compressor maintains its stopped state during the first designated time (T1) in third section, and then is operated during the second designated time (T2) in fourth section so as to restore the lowered oil level.

Therefore, in the compressor-controlling device and method for an air conditioner comprising a plurality of compressors of the present invention, when several compressors selected from the plural compressors are operated according to the cooling or heating load and the other compressors are stopped during the first designated time (T1), the stopped compressors are operated during the second designated time (T2), thereby restoring the lowered oil level within the stopped compressors.

As apparent from the above description, the present invention provides compressor-controlling device and method for an air conditioner comprising a plurality of compressors, in which stopped compressors are intermittently operated when compressors are selectively operated for satisfying the variation of cooling or heating load. That is, in case several compressors selected from the plural compressors are stopped according to the cooling or heating load, a control unit senses stopped time of the stopped compressors, and operates the stopped compressors during a second designated time when the stopped time exceeds a designated first time, so that oil leakage from the inside of the stopped compressor to a refrigerant pipe of an inlet port is prevented, thereby protecting the stopped compressors from damage due to poor lubrication in the operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A compressor-controlling device for an air conditioner comprising a plurality of compressors, in which the plural compressors are simultaneously or selectively operated according to cooling or heating load, comprising:

a timer that senses stopped time of stopped compressors selected from the plural compressors according to the cooling or heating load;

a comparing unit that determines whether the stopped time sensed by the timer exceeds a first predetermined time; and a control unit that operates the stopped compressors in case the comparing unit judges that the stopped time exceeds the first predetermined time.

2. The compressor-controlling device for an air conditioner comprising a plurality of compressors as set forth in claim 1, wherein the first predetermined time is a time required to cause the lowering of an oil level within the stopped compressors.

3. The compressor-controlling device for an air conditioner comprising a plurality of compressors as set forth in claim 1, wherein the control unit operates the stopped compressors after a lapse of the first predetermined time, and then re-stops the compressors.

4. The compressor-controlling device for an air conditioner comprising a plurality of compressors as set forth in claim 3, wherein the second predetermined time is a time required to restore the oil level within the stopped compressors.

5. The compressor-controlling device for an air conditioner comprising a plurality of compressors as set forth in claim 3, wherein the comparing unit comprises a memory unit in which the first and second predetermined times are stored.

6. A compressor-controlling method for an air conditioner comprising a plurality of compressors, in which the plural compressors are simultaneously or selectively operated according to cooling or heating load, comprising:

sensing stopped time of stopped compressors when several compressors selected from the plural compressors are stopped according to the cooling or heating load;

determining whether the stopped time exceeds a first predetermined time; and operating the stopped compressors when it is judged that the stopped time exceeds the first predetermined time.

7. The compressor-controlling method for an air conditioner comprising a plurality of compressors as set forth in claim 6, wherein the operating comprises operating the stopped compressors during a second predetermined time and then re-stopping the compressors.

8. The compressor-controlling method for an air conditioner comprising a plurality of compressors as set forth in claim 6, wherein the first predetermined time is a time required to cause a lowering of the oil level within the stopped compressors.

9. A compressor-controlling method for an air conditioner comprising a plurality of compressors, in which the plural compressors are simultaneously or selectively operated according to cooling or heating load, comprising:

sensing stopped time of stopped compressors when several compressors selected from the plural compressors are stopped according to the cooling or heating load;

determining whether the stopped time exceeds a first predetermined time; and operating the stopped compressors when it is judged that the stopped time exceeds the first predetermined time, wherein the operating comprises operating the stopped compressors during a second predetermined time and then re-stopping the compressors, and wherein after the operating the stopped compressors during the second predetermined time and then re-stopping the compressors, the determining and the operating are repeatedly carried out.

10. A compressor-controlling method for an air conditioner comprising a plurality of compressors, in which the plural compressors are simultaneously or selectively operated according to cooling or heating load, comprising:

sensing stopped time of stopped compressors when several compressors selected from the plural compressors are stopped according to the cooling or heating load;

determining whether the stopped time exceeds a first predetermined time; and operating the stopped compressors when it is judged that the stopped time exceeds the first predetermined time, wherein the operating comprises operating the stopped compressors during a second predetermined time and then re-stopping the compressors, and wherein the second predetermined time is a time required to restore an oil level within the stopped compressors.

* * * * *

UNITED STATES PATENT AND TRADEMARK OFFICE

CERTIFICATE OF CORRECTION

PATENT NO. : 6,871,505 B2
DATED : March 29, 2005
INVENTOR(S) : M. H. So et al.

It is certified that error appears in the above-identified patent and that said Letters Patent is hereby corrected as shown below:

Title page,
Item [30], Foreign Application Priority Data, "2000-38377" should be
-- 2002-38377 --.

Signed and Sealed this

Twenty-second Day of November, 2005

JON W. DUDAS
*Director of the United States Patent and Trademark Office*